US009188923B2

(12) United States Patent
Kurahashi

(10) Patent No.: US 9,188,923 B2
(45) Date of Patent: Nov. 17, 2015

(54) IMAGE FORMING APPARATUS WITH AN IMPROVED PATTERN IMAGE GENERATING UNIT USING TEST PATTERNS

(71) Applicant: KYOCERA Document Solutions Inc.

(72) Inventor: Taro Kurahashi, Osaka (JP)

(73) Assignee: Kyocera Document Solutions Inc. (JP)

( * ) Notice: Subject to any disclaimer, the term of this patent is extended or adjusted under 35 U.S.C. 154(b) by 23 days.

(21) Appl. No.: 14/161,814

(22) Filed: Jan. 23, 2014

(65) Prior Publication Data

US 2014/0212162 A1 Jul. 31, 2014

(30) Foreign Application Priority Data

Jan. 29, 2013 (JP) ..... 2013-014703

(51) Int. Cl.
*G03G 15/00* (2006.01)

(52) U.S. Cl.
CPC ..... *G03G 15/5041* (2013.01); *G03G 15/5058* (2013.01)

(58) Field of Classification Search
None
See application file for complete search history.

(56) References Cited

U.S. PATENT DOCUMENTS

| | | | | |
|---|---|---|---|---|
| 8,948,631 | B2 * | 2/2015 | Honda | 399/49 |
| 2004/0141765 | A1 * | 7/2004 | Shimura et al. | 399/49 |
| 2007/0025748 | A1 * | 2/2007 | Ishibashi et al. | 399/49 |
| 2007/0116483 | A1 | 5/2007 | Kobayashi | |
| 2009/0238591 | A1 * | 9/2009 | Watanabe et al. | 399/51 |
| 2011/0033196 | A1 * | 2/2011 | Fuchimoto | 399/49 |
| 2011/0076040 | A1 * | 3/2011 | Uchidate et al. | 399/49 |
| 2011/0229173 | A1 * | 9/2011 | Nakayama | 399/53 |
| 2012/0155899 | A1 * | 6/2012 | Watanabe et al. | 399/49 |
| 2012/0162670 | A1 * | 6/2012 | Ohnishi et al. | 358/1.4 |
| 2012/0274986 | A1 * | 11/2012 | Harashima et al. | 358/3.21 |
| 2013/0236200 | A1 * | 9/2013 | Tanaka et al. | 399/49 |
| 2014/0268242 | A1 * | 9/2014 | Kaneko et al. | 358/3.06 |
| 2014/0270828 | A1 * | 9/2014 | Suzuki et al. | 399/55 |

FOREIGN PATENT DOCUMENTS

| | | |
|---|---|---|
| JP | 2003-255628 | 9/2003 |
| JP | 2012-230312 | 11/2012 |

* cited by examiner

*Primary Examiner* — David Gray
*Assistant Examiner* — Geoffrey Evans

(57) ABSTRACT

The development roller adheres toner to an electrostatic latent image on the photo conductor drum in order to develop a toner image. The pattern image generating unit develops two pattern images that are two sets of plural test patches for calibration on the photo conductor drum. Each one of the pattern images includes the test patches corresponding to densities in gradation. Further, the pattern image generating unit sets an interval between a top of the first pattern image and a top of the second pattern image so that a remainder for the interval divided by a density fluctuation pitch is larger than a length of the test patch. The density fluctuation pitch is the product of a periphery length of the development roller and a ratio between a rotating speed of the development roller and a rotating speed of the photo conductor drum.

6 Claims, 6 Drawing Sheets

IMAGE FORMING APPARATUS WITH AN IMPROVED PATTERN IMAGE GENERATING UNIT USING TEST PATTERNS

CROSS-REFERENCE TO RELATED APPLICATIONS

This application relates to and claims priority rights from Japanese Patent Application No. 2013-014703, filed on Jan. 29, 2013, the entire disclosures of which are hereby incorporated by reference herein.

BACKGROUND

1. Field of the Present Disclosure

The present disclosure relates to an image forming apparatus.

2. Description of the Related Art

In an image forming apparatus such as a printer, a copy machine, a facsimile machine or a multi function peripheral, calibration is performed as a density correction technique for image forming. In the calibration, light is irradiated to a photo conductor drum by an exposure device and consequently an electrostatic latent image of test patches (an image for density correction) is formed on the photo conductor drum; a toner image is formed by supplying toner to the electrostatic latent image from a development device; and after transferring the toner image to an intermediate transfer drum, densities of the image is optically measured using an optical sensor or the like, exposure light intensity of the exposure device, a surface voltage of the photo conductor drum, a development bias of the development device and so forth are adjusted on the basis of the measured density of the image for correcting densities of image forming.

In an image forming apparatus that includes a development roller arranged in a development device in order to supply toner to a photo conductor drum, if development characteristic is not uniform to rotation angles of the development roller due to eccentricity of a rotation shaft, unevenness of a roller surface of the development roller and so forth, then developer is ununiformly distributed on the outer surface of the development roller, toner does not precisely adhere from the development roller to a photo conductor drum by an expected toner amount, and consequently a whole area of a test patch may not have an uniform density on the photo conductor drum. In such a case, the precise calibration may not be performed.

In an image forming apparatus, in order to reduce density unevenness of a test patch, a test patch is used of which a length on a photo conductor drum is larger than a periphery length of a development roller, and an average value of densities within the test patch is measured.

In the aforementioned image forming apparatus, the length of the test patch is larger than the periphery length of the development roller, and therefore if the periphery length of the development roller is large then the length of the test patch must be large. A large length of the test patch results in a large toner consumption amount on the test patch and a long time required for the calibration.

Further, for example, it may be considered that two pattern images that are two sets of test patches corresponding to densities in gradation are formed and a measured density corresponding to a density setting value is calculated from a measured density of a test patch of the first set and a measured density of a test patch of the second set. However, as shown in FIG. 6A and FIG. 6B, if a position of the test patch of the first set and a position of the test patch of the second set within a fluctuation pitch (i.e. a fluctuation period) of density unevenness are close to each other, the density unevenness still affects the measured densities of the both test patches and consequently influence of the density unevenness is not reduced.

SUMMARY

An image forming apparatus according to an aspect of the present disclosure, includes a photo conductor drum, a development roller, and a pattern image generating unit. The development roller is configured to adhere toner to an electrostatic latent image on the photo conductor drum in order to develop a toner image. The pattern image generating unit is configured to develop two pattern images that are two sets of plural test patches for calibration on the photo conductor drum. Each one of the pattern images includes the test patches corresponding to densities in gradation. The pattern image generating unit is further configured to set an interval between a top of the first pattern image and a top of the second pattern image so that a remainder for the interval divided by a density fluctuation pitch is larger than a length of the test patch. The density fluctuation pitch is the product of a periphery length of the development roller and a ratio between a rotating speed of the development roller and a rotating speed of the photo conductor drum.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
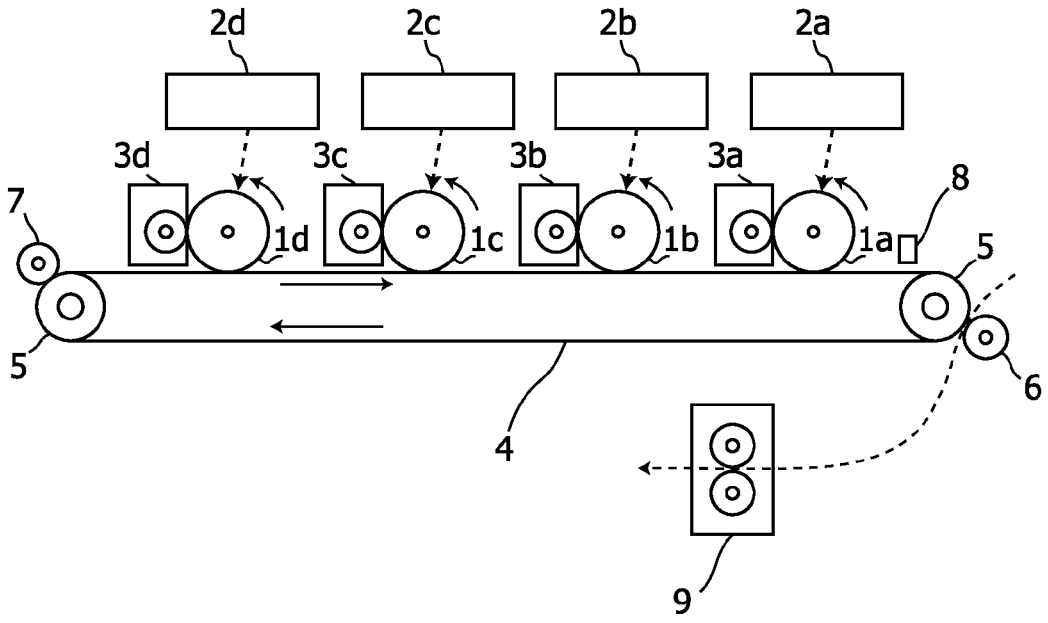
FIG. 1 shows a side view that indicates a partial internal mechanical configuration of an image forming apparatus in Embodiment 1 according to the present disclosure.

FIG. 1 shows a side view that indicates a partial internal mechanical configuration of an image forming apparatus in Embodiment 1 according to the present disclosure. This image forming apparatus is an apparatus having a printing function such as a printer, a facsimile machine, a copier, or a multi function peripheral.

The image forming apparatus in this embodiment includes a tandem-type color image forming unit. The color image forming unit includes photo conductor drums 1*a* to 1*d*, exposure devices 2*a* to 2*d*, and development devices 3*a* to 3*d*. The photo conductor drums 1*a* to 1*d* are four color photo conductors of Cyan, Magenta, Yellow and Black.

The exposure devices 2*a* to 2*d* are devices that form electrostatic latent images by irradiating laser light to the photo conductor drums 1*a* to 1*d*, respectively. The laser light is scanned in the direction (the primary scanning direction) perpendicular to the rotation direction (the secondary scanning direction) of the photo conductor drum 1*a*, 1*b*, 1*c* or 1*d*. The exposure devices 2*a* to 2*d* include laser scanning units that include laser diodes as light sources of the laser light, optical elements (such as lens, mirror and polygon mirror) that guide the laser light to the respective photo conductor drums 1*a* to 1*d*.

Further, in the periphery of each one of the photo conductor drums 1*a* to 1*d*, a charging unit such as scorotron, a cleaning device, a static electricity eliminator and so on are disposed. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

The development devices 3*a* to 3*d* are connected respective toner containers filled up with toner of four colors: Cyan, Magenta, Yellow, and Black, and form toner images by supplying the toner supplied from the toner containers to the respective photo conductor drums 1*a* to 1*d*, and adhering the toner on electrostatic latent images on the photo conductor drums 1*a* to 1*d*.

The photo conductor drum 1*a*, the exposure device 2*a* and the development device 3*a* perform image forming of Magenta. The photo conductor drum 1*b*, the exposure device 2*b* and the development device 3*b* perform image forming of Cyan. The photo conductor drum 1*c*, the exposure device 2*c* and the development device 3*c* perform image forming of Yellow. The photo conductor drum 1*d*, the exposure device 2*d* and the development device 3*d* perform image forming of Black.

Figure 2:
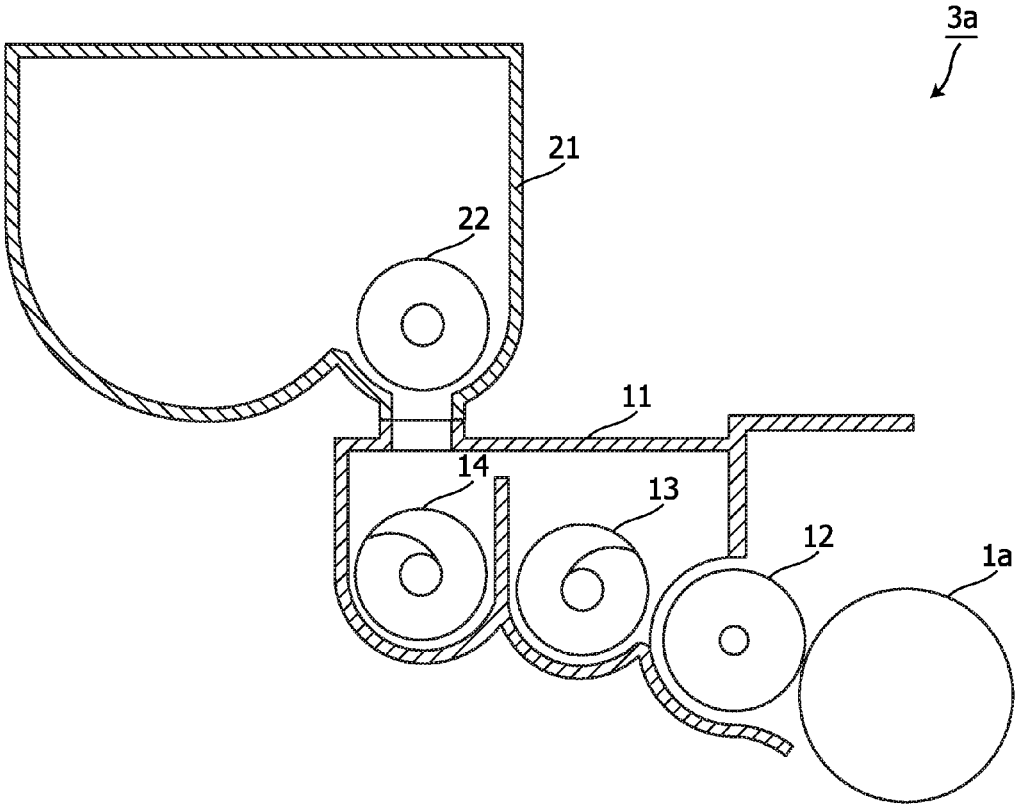
FIG. 2 shows a cross-sectional diagram that indicates an example of a development device in FIG. 1.

FIG. 2 shows a cross-sectional diagram that indicates an example of the development device 3*a* in FIG. 1. FIG. 2 shows the development device 3*a* and its periphery, and the development device 3*b*, 3*c* or 3*d* and its periphery has the same configuration.

As shown in FIG. 2, the development device 3*a* includes a housing 11, a development roller 12, and agitation screws and 14. A toner container 21 is attached to the development device 3*a*, and toner is supplied from the toner container 21 to the development device 3*a* by rotation of a toner supplying roller 22 in the toner container 21. A development roller 12 adheres the toner to an electrostatic latent image on the photo conductor drum la in order to develop a toner image.

Returning to FIG. 1, the intermediate transfer belt 4 is a loop-shaped image carrier and intermediate transfer member, and contacts the photo conductor drums 1*a* to 1*d*. Toner images on the photo conductor drums 1*a* to 1*d* are primarily transferred onto the intermediate transfer belt 4. The intermediate transfer belt 4 is hitched round driving rollers 5, and rotates by driving force of the driving rollers 5 towards the direction from the contact position with the photo conductor drum 1*d* to the contact position with the photo conductor drum 1*a*.

A transfer roller 6 makes a conveyed paper sheet contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet.

A sensor 8 irradiates light (i.e. detection light) to the intermediate transfer belt 4 and detects its reflection light. Intensity of the reflection light varies accordingly to toner density and/or glossiness of a surface of the intermediate transfer belt 4. During calibration (i.e. density adjustment and gradation adjustment), the sensor 8 irradiates light to a predetermined area on the intermediate transfer belt 4, detects its reflection light, and outputs an electrical signal corresponding to the detected intensity of the reflection light. This electrical signal is input to a controller 31 mentioned below directly or via an amplifier circuit, and is sampled.

Figure 3:
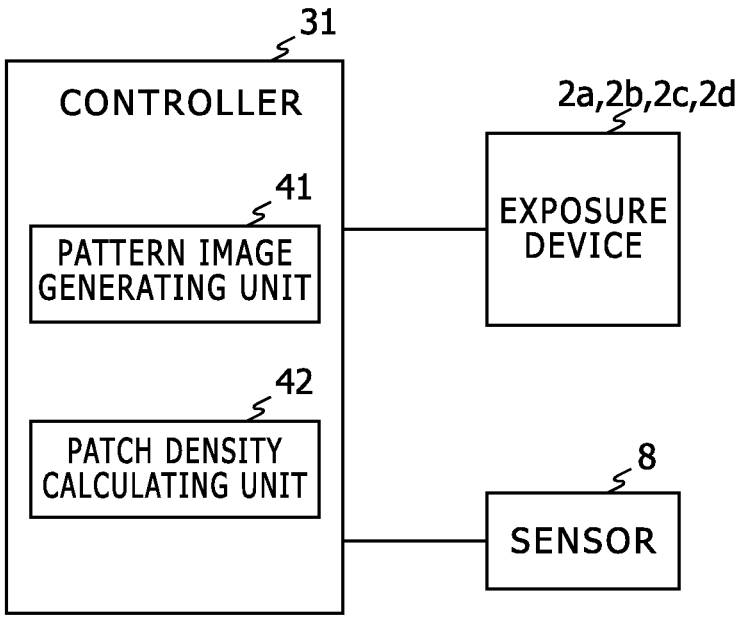
FIG. 3 shows a block diagram that indicates a controller that controls development of a toner image using the development device in FIGS. 1 and 2.

FIG. 3 shows a block diagram that indicates the controller 31 that controls development of a toner image using the development devices 3*a* to 3*d* in FIGS. 1 and 2.

The controller 31 is a processing circuit and controls a driving source that drives the aforementioned rollers, a bias induction circuit that induces a development bias and a primary transfer bias, and the exposure devices 2*a* to 2*d* in order to perform forming an electrostatic latent image, developing a toner image, transferring and fixing the toner image, feeding a sheet of paper, printing on the sheet, and outputting the sheet. The development biases are applied between the photo conductor drums 1*a* to 1*d* and the development devices 3*a* to 3*d*, respectively. The primary transfer biases are applied between the photo conductor drums 1*a* to 1*d* and the intermediate transfer belt 4, respectively. When a toner image is developed, the controller 31 reads a gradation correction table, and corrects density of each gradation level on the basis of the table, and performs development of a toner image of the corrected density. In the calibration, this gradation correction table is adjusted.

The controller 31 includes a pattern image generating unit 41 and a patch density calculating unit 42.

When calibration is performed, the pattern image generating unit 41 develops two pattern images that are two sets of plural test patches for the calibration on the photo conductor drum 1*a*.

Each one of the pattern images includes test patches corresponding to densities in gradation. In this embodiment, each one of the pattern images includes test patches corresponding to densities in gradation for each one of the toner colors: Cyan, Magenta, Yellow, and Black. A length of each one of the test patches (a length in the secondary scanning direction) is shorter than a periphery length of the development roller 12.

Further, the pattern image generating unit 41 sets an interval L between a top of the first pattern image and a top of the second pattern image by controlling exposure timings of the exposure device 2*a* so that a remainder for the interval L divided by a density fluctuation pitch P is larger than a length of the test patch (a length in the secondary scanning direction). The density fluctuation pitch P is the product of a periphery length Lo of the development roller 12 and a ratio between a rotating speed S of the development roller 12 and a rotating speed D of the photo conductor drum 1*a* (P=Lo*S/D).

In this embodiment, the pattern image generating unit 41 sets the interval L so that the aforementioned remainder is substantially 50 percent of the density fluctuation pitch P.

Further, in this embodiment, the pattern image generating unit 41 sets the interval L so that the interval L is one of integral multiplications of the length of the test patch to make the remainder closest to 50 percent of the density fluctuation pitch.

Figure 4:
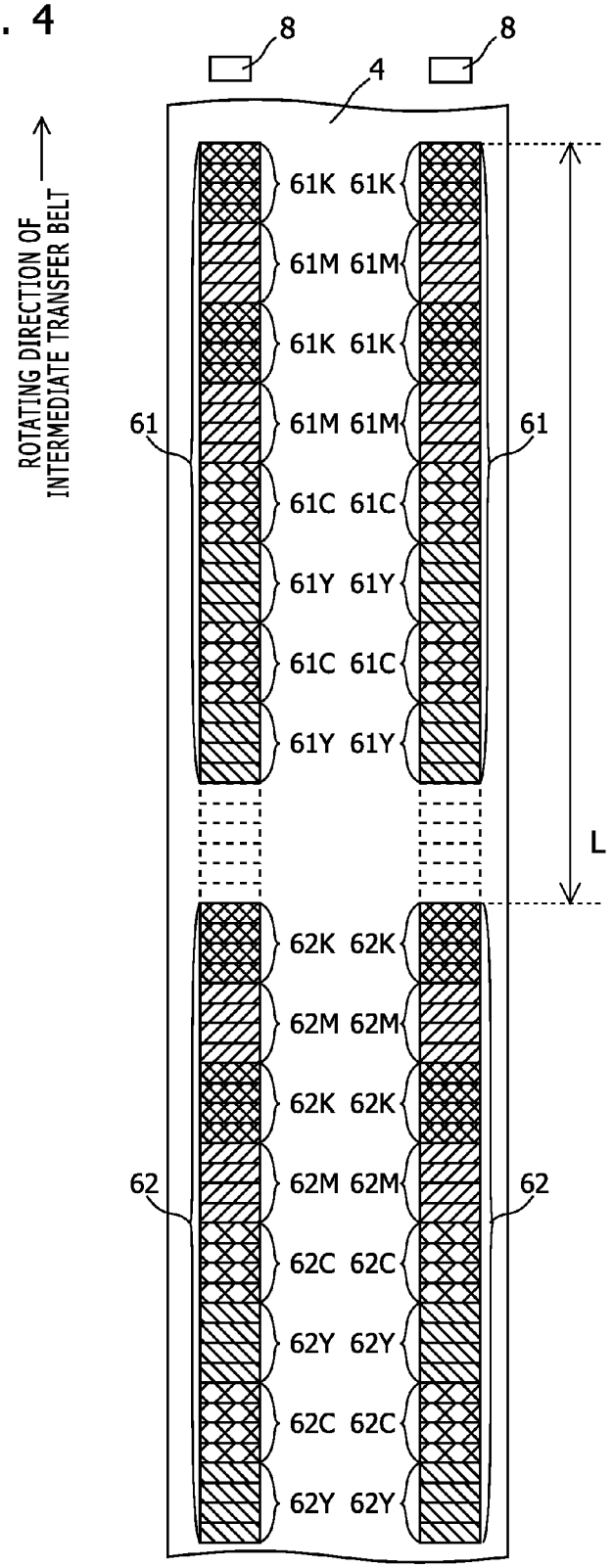
FIG. 4 shows an example of two pattern images formed in the image forming apparatus shown in FIG. 1.

FIG. 4 shows an example of two pattern images formed in the image forming apparatus shown in FIG. 1.

In an example shown in FIG. 4, two test patch arrays 61 are formed in the first pattern image. Each one of the test patch array 61 includes eight test patches 61C, eight test patches 61M, eight test patches 61Y and eight test patches 61K corresponding to density setting values different from each other for Cyan, Magenta, Yellow, and Black. In the same manner, two test patch arrays 62 are formed in the second pattern image. Each one of the test patch array 62 includes eight test patches 62C, eight test patches 62M, eight test patches 62Y and eight test patches 62K corresponding to density setting values different from each other for Cyan, Magenta, Yellow, and Black.

The patch density calculating unit 42 calculates an average value of measured density values of two test patches corresponding to one density setting value in the first pattern image and the second pattern image as a measured density corresponding to the density setting value.

Pattern image generating units and patch density calculating units for the development devices 3*b* to 3*d* are established as well as the pattern image generating unit 41 and the patch density calculating unit 42.

In the following part, a behavior of the aforementioned image forming apparatus is explained.

Figure 5A:
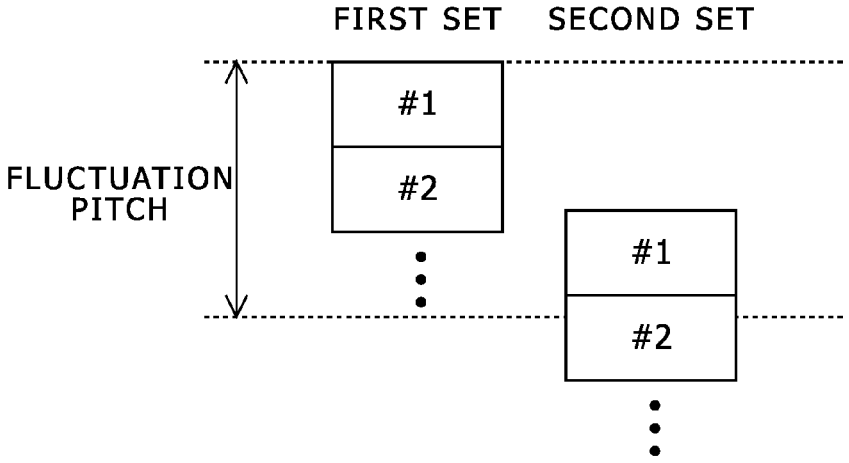
FIGS. 5A and 5B show diagrams that explain a relationship between positions of test patches in two pattern images formed in the image forming apparatus shown in FIG. 1.
Figure 5B:
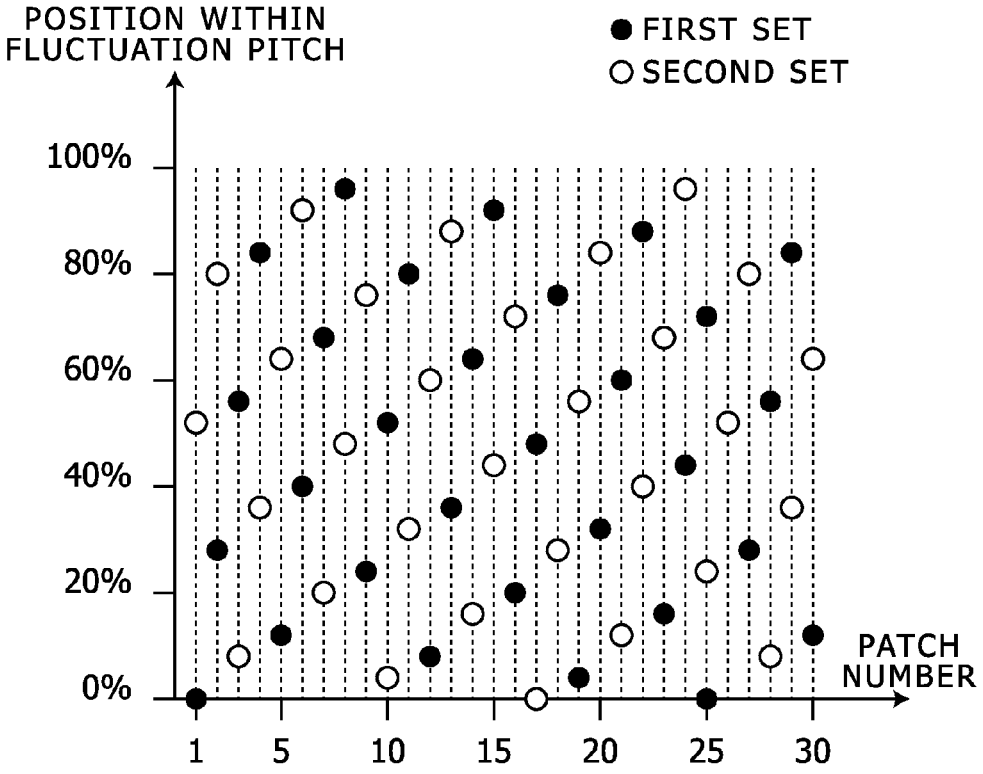
Figure 6A:
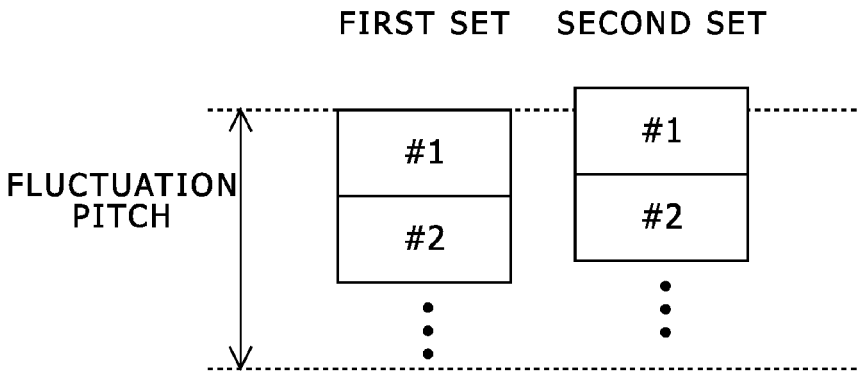
FIGS. 6A and 6B show diagrams that explain an example of a relationship between positions of test patches in two pattern images.
Figure 6B:
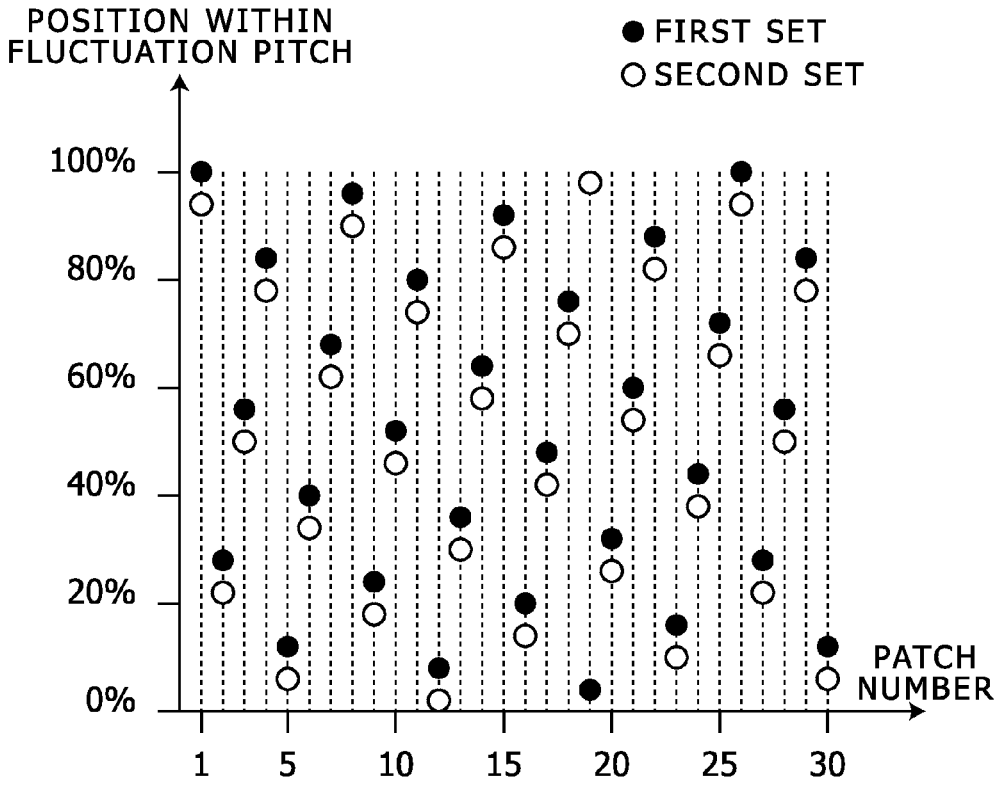

FIGS. 5A and 5B show diagrams that explain a relationship between positions of test patches in two pattern images formed in the image forming apparatus shown in FIG. 1.

In this embodiment, the pattern image generating unit 41 sets an interval L between a top of the first pattern image 61 and a top of the second pattern image 62 so that a remainder for the interval L divided by the density fluctuation pitch P is larger than a length of the test patch (a length of one test patch in the secondary scanning direction). The density fluctuation pitch P is the product of a periphery length Lo of the development roller 12 and a ratio between a rotating speed S of the development roller 12 and a rotating speed D of the photo conductor drum 1*a* (P=Lo*S/D). Therefore, as shown in FIG. 5A and FIG. 5B, for each one of the density setting values, a position of the test patch in the first set (i.e. in the first pattern image) and a position of the test patch in the second set (i.e. in the second pattern image) are distant from each other in the density fluctuation pitch P. It should be noted that patch numbers in FIGS. 5A and 5B indicate the order of test patches from the top in the pattern image 61 or 62.

When calibration is performed, the pattern image generating unit 41 controls exposure timings of the exposure devices 2*a* to 2*d* and forms the first pattern image 61 on the intermediate transfer belt 4 and subsequently forms the second pattern image 62 on the intermediate transfer belt 4 at the aforementioned interval L.

The patch density calculating unit 42 identifies a measured density of each test patch in the first and second pattern images 61 and 62 on the basis of output values from the sensor 8, and calculates an average of the two measured densities in the first and the second pattern images 61 and 62 as a measured density for each density setting value of each toner color. The controller 31 adjusts a density correction amount for each density in a printed image on the basis of this measured density.

In the aforementioned embodiment, within the density fluctuation pitch P, a position of the test patch in the first set and a position of the test patch in the second set are distant from each other, and consequently, calculating an average of measured densities of these test patches reduces influence of the density unevenness.

The description has been presented for purposes of illustration and description, and is not intended to be exhaustive or limited.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a photo conductor drum;

a development roller configured to adhere toner to an electrostatic latent image on the photo conductor drum in order to develop a toner image; and a pattern image generating unit configured to develop two pattern images that are two sets of plural test patches for calibration on the photo conductor drum;

wherein each one of the pattern images includes the test patches corresponding to densities in gradation;

the pattern image generating unit is further configured to set an interval between a top of the first pattern image and a top of the second pattern image so that a remainder for the interval divided by a density fluctuation pitch is larger than a length of the test patch; and the density fluctuation pitch is the product of a periphery length of the development roller and a ratio between a rotating speed of the development roller and a rotating speed of the photo conductor drum; wherein the pattern image generating unit is further configured to set the interval so that the remainder is substantially 50 percent of the density fluctuation pitch.

2. The image forming apparatus according to claim 1, wherein the length of the test patch is shorter than the periphery length of the development roller.

3. The image forming apparatus according to claim 1, further comprising a patch density calculating unit configured to calculate an average value of measured density values of test patches corresponding to a density setting value in the first pattern image and the second pattern image as a measured density corresponding to the density setting value.

4. An image forming apparatus, comprising:

a photo conductor drum;

a development roller configured to adhere toner to an electrostatic latent image on the photo conductor drum in order to develop a toner image; and a pattern image generating unit configured to develop two pattern images that are two sets of plural test patches for calibration on the photo conductor drum;

wherein each one of the pattern images includes the test patches corresponding to densities in gradation;

the pattern image generating unit is further configured to set an interval between a top of the first pattern image and a top of the second pattern image so that a remainder for the interval divided by a density fluctuation pitch is larger than a length of the test patch; and the density fluctuation pitch is the product of a periphery length of the development roller and a ratio between a rotating speed of the development roller and a rotating speed of the photo conductor drum; wherein the pattern image generating unit is further configured to set the interval so that the interval is one of integral multiplications of the length of the test patch to make the remainder closest to 50 percent of the density fluctuation pitch.

5. The image forming apparatus according to claim 4, wherein the length of the test patch is shorter than the periphery length of the development roller.

6. The image forming apparatus according to claim 4, further comprising a patch density calculating unit configured to calculate an average value of measured density values of test patches corresponding to a density setting value in the first pattern image and the second pattern image as a measured density corresponding to the density setting value.

* * * * *